United States Patent [19]

Liu

[11] Patent Number: 4,577,424

[45] Date of Patent: Mar. 25, 1986

[54] ELECTRICAL SAFETY IRON

[76] Inventor: Yung-Ho Liu, 111, Si Wei Street, San Chung City, Taipei Province, 241, Taiwan

[21] Appl. No.: 643,698

[22] Filed: Aug. 24, 1984

[51] Int. Cl.[4] ..... D06F 75/26

[52] U.S. Cl. ..... 38/88; 38/90; 219/250

[58] Field of Search ..... 38/90, 81, 88; 219/250

[56] References Cited

U.S. PATENT DOCUMENTS

| | | | |
|---|---|---|---|
| 2,366,014 | 12/1944 | Finlayson | 219/250 X |
| 3,424,894 | 1/1969 | Schwartz et al. | 219/250 |
| 4,203,101 | 5/1980 | Towsend | 219/250 X |
| 4,366,366 | 12/1982 | Ekblad | 219/250 X |

*Primary Examiner*—Werner H. Schroeder
*Assistant Examiner*—Andrew M. Falik
*Attorney, Agent, or Firm*—Bacon & Thomas

[57] ABSTRACT

An electrical safety iron includes a safey circuit that automatically cuts off power if a pause of operation exceeds a prescribed time limit and lifts the main body of the iron from the surface being ironed so as to avoid damaging the texture of the fabric being ironed or causing a fire. An override preheat switch is provided to enable supply of power to the heater of the iron even if it is unattended, provided it is supported in the upright position. An electrical time delay circuit controls timing of the automatic power cutoff and lifting of the iron when it is unattended.

10 Claims, 6 Drawing Figures

ELECTRICAL SAFETY IRON

BACKGROUND OF THE INVENTION

The present invention relates to an electrical safety iron that increases safety while ironing clothes or other fabric. The iron prevents a fire that might be caused by the overheating of the object being ironed; such overheating could overheat an insulation means, such as a cushion, location underneath the fabric being ironed and eventually produce a major fire. The ability of an iron to overheat and cause a major fire is due in part by the lack of a safety device incorporated in an iron to prevent overheating, particularly when the iron is in its ironing position. The present invention incorporates an electric circuit which makes it possible to quickly cut off heat to the iron by terminating power to the iron after a predetermined time limit following suspension of an ironing operation.

SUMMARY OF THE INVENTION

The present invention provides a safety iron having a hand grip designed for manual holding, considering the structure of the palm as well as associated ergonomics such that the operator will feel comfortable using the iron. Structurally, the grip is hollow and contains a push-button main control switch in the forward area thereof incorporating two sets of ON/OFF contacts within, one set normally closed, the other set normally open. A switch plunger is mounted to the top area of the grip and fits within a recess in the grip in a manner whereby it may be pivoted about a fixed axis to operate the switch. The front of the plunger is in contact with the push-button of the main control switch but normally does not actuate the switch. To operate the iron, the user's hand holds the grip tight to pivot the plunger to close an open switch and to open a closed switch to control energization of the heater electrical circuit. When the force exerted by the operator's palm is released from the grip, the push-button of the control switch will be released forthwith to reset the contacts, thereby cutting off power to the iron.

The safety iron device structured according to the present invention further incorporates a hollow cylinder or tube interconnecting the iron body section with the grip. The cylinder is made of insulating material so as to prevent passage of the heat produced by the body section to the grip. A compression spring in the interconnecting cylinder is positioned adjacent the grip. A movable support rod comprising a base having a locking groove in a central area along its length and a tapered top area fits within the cylinder against the spring with the latter in compressed condition biasing the rod toward the iron body. The support rod is locked in position by a locking pin controlled by a solenoid.

The safety iron device structured according to the invention further incorporates a number of current control switches for controlling the power input to the heater of the iron. The locking pin constitutes the solenoid plunger and a spring biases the locking pin into engagement with the groove of the movable support rod when the solenoid is not energized. By retracting the locking pin from the locking groove of the support rod by energizing the solenoid, the support rod will be extended below the iron body by the compression spring to lift the iron relative to an underlying support surface and a fabric being ironed while simultaneously the electrical energy to the iron heater is cut off.

The safety iron device structured according to the present invention further incorporates a push-button override switch on the heel of the grip so that setting the iron to stand on its rear side on the grip heel causes the weight of the iron to depress the push-button override switch to close the heating circuit even if the main control switch is not closed. Thus, the iron produces heat for ironing and the push-button switch is arranged to automatically reset while the iron is in service, although the heater is normally controlled through the main switch in the grip.

To achieve a smooth control of all the functions mentioned above, the present invention provides a novel electronic control circuit. The controller comprises a delayed triggering circuit composed of an integrated chip and solenoid circuit. Input power to both circuits goes through a step-down transformer and a full-wave diode rectifier to produce an output power supply.

DESCRIPTION OF THE PREFERRED EMBODIMENT

With reference to the accompanying illustrations, the safety iron of the present invention comprises a body section 14 having a hollow grip section 1 connected to the body section by means of a tubular member 13, with both the tubular member and the grip being made of insulation materials.

Figure 1:
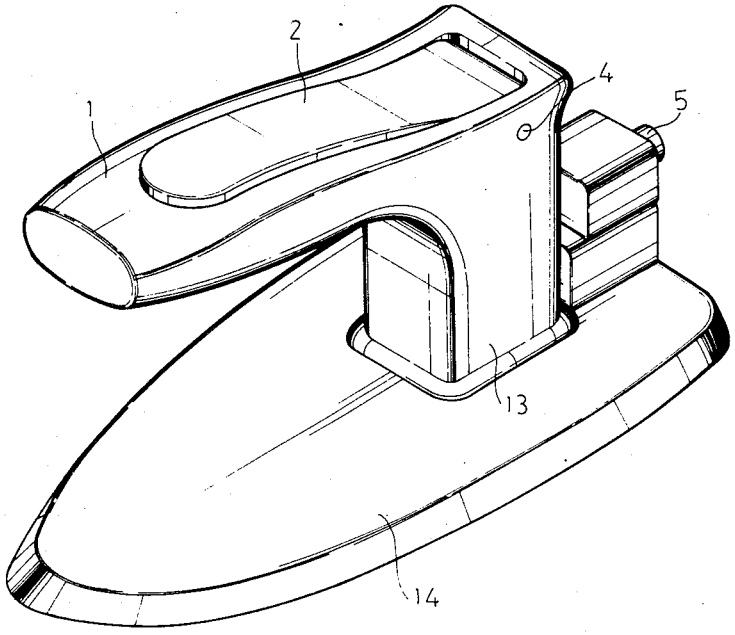
FIG. 1 is a perspective view of an iron embodying the invention.
Figure 2:
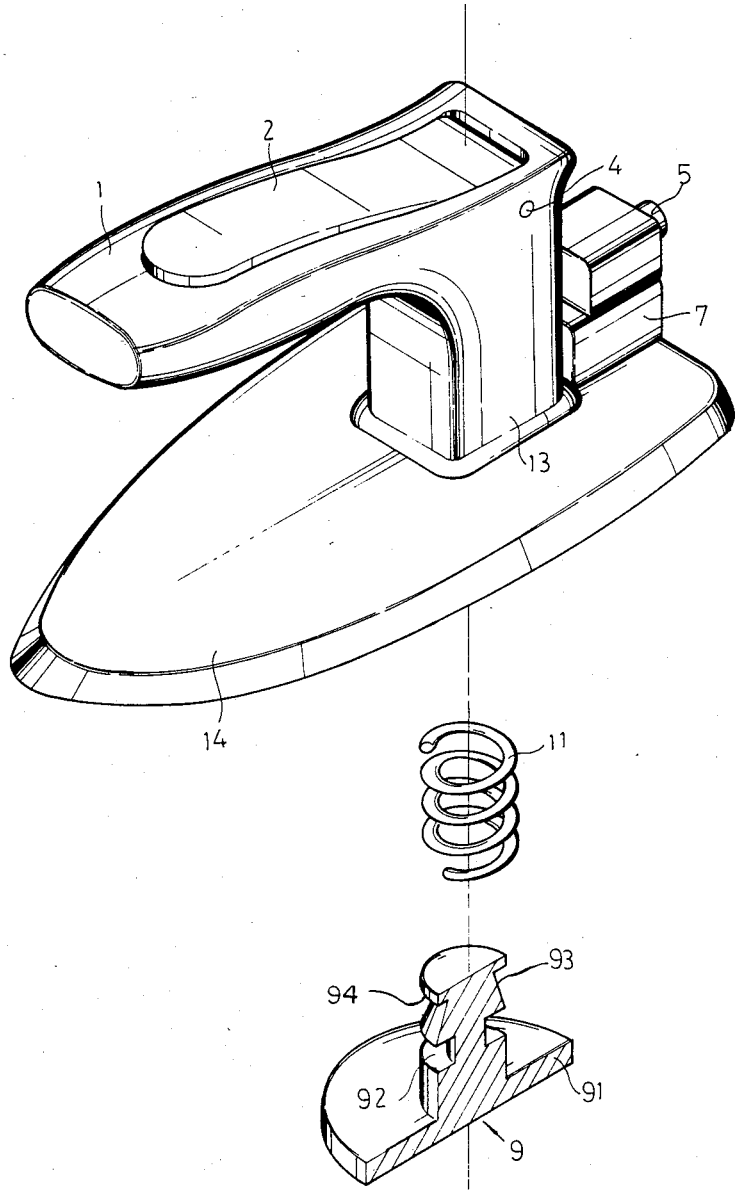
FIG. 2 is an exploded view of the iron illustrating the support and lifting system.
Figure 3:
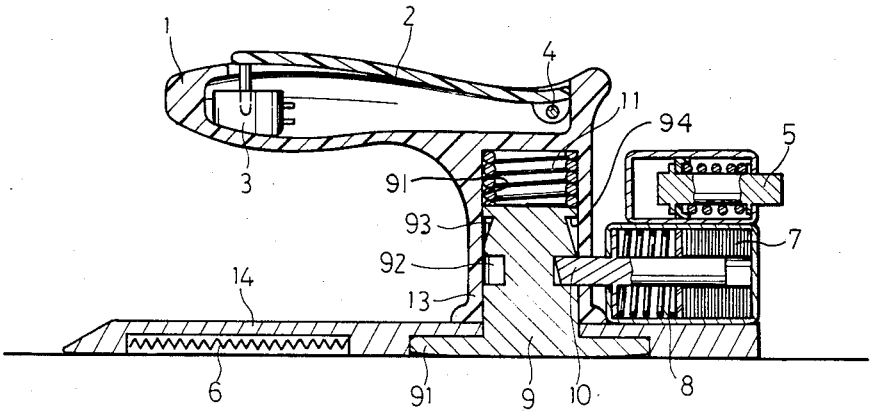
FIG. 3 is a mid-section view of the iron.
Figure 6:
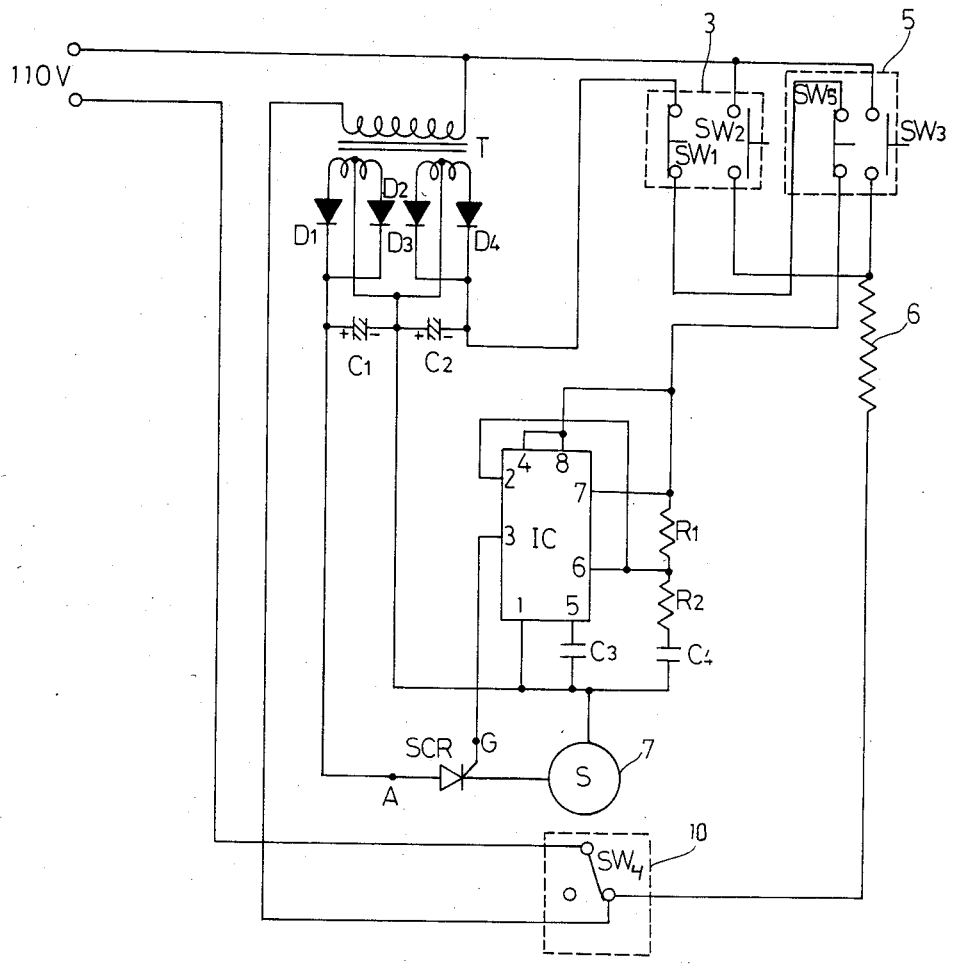
FIG. 6 is a schematic view of the preferred control circuit for the present invention.

As shown in FIGS. 1 and 3, in the hollow portion of the forward section of the grip section 1, there is mounted a main control switch 3 having one set of normally closed contacts SW1 and one set of normally open contacts SW2 as shown in FIG. 6. The grip is arranged so that the switch plunger 2 engages switch 3. The plunger 2 rotates about bearing shaft 4 whereby, in operation, the grip section 1 is held in one hand with the thumb pressing against the plunger to depress the push-button of the switch 3 to close SW2 and open SW1. Depression of switch 3 thereby closes the electrical AC circuit to energize heating coil 6. The open SW1 inactivates the time delay control circuit for the iron, which will be described in more detail below. Hence, by depressing plunger 2, the heating coil 6 continues to discharge the necessary heat required to iron fabrics.

Figure 4:
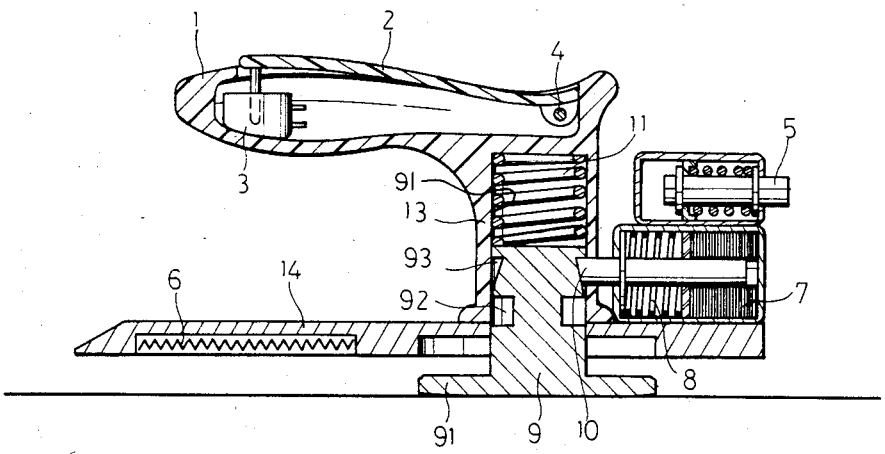
FIG. 4 is similar to FIG. 3 with the support system extended.

Referring to FIG. 3, an interconnection tube 13 is made of insulating material and contains a main compression spring 11 adjacent the grip 1 for biasing cylindrical rod 9 disposed in the hollow core of the tube 13 toward the iron body. The underside of the movable support rod is enlarged in the shape of a disk 91 that fits flush in an enlarged opening or recess in the bottom of the iron body when rod 9 is in its retracted position within the core of the tube 13. The cylindrical shaft area of the movable support rod 9 includes an annular undercut groove 92 to accommodate a locking pin 10 constituting a plunger of a control solenoid 7. The locking pin 10 is normally biased toward rod 9 by spring 98 and extends radially through tube 13 to lock rod 9 in retracted position against the bias of spring 11. Actuation of the solenoid 7 retracts pin 10 to permit extension of rod 9 as shown in FIG. 4 to lift the iron body above a support surface under the action of spring 11. As shown in FIG. 6, a switch contact SW4 is controlled by a portion of plunger 10 of solenoid 7 and normally is in closed position to maintain circuit continuity to the heating coil 6. Switch contact SW2, of course, must be closed to energize the heater 6.

As shown in FIG. 4, when solenoid withdraws pin 10, rod 9 is extended to lift the iron. This occurs after a predetermined time delay after grip plunger 2 is released through operation of a time delay control circuit. In operation, the withdrawal of the operator's hand from grip 1 releases plunger 2 to reset switch 3. Switch contact SW2 is opened to open the circuit to the heating coil 6 and the switch contact SW1 is closed to energize the IC delay circuit shown in FIG. 6. The IC circuit generates a pluse supplied to the gate of an SCR to enable SCR to conduct within a predetermined period of time. When the SCR is conductive, the circuit to solenoid 7 is closed to pull pin 7 out of engagement with rod 9 to permit spring 11 to extend rod 9 as shown in FIG. 4. As a result, the iron body 14 is lifted off the support surface and the fabric. The movement of the pin 10 to retracted position also causes opening of switch contact SW4 to open the circuit to the solenoid 7 to permit pin 10 to quickly return toward the rod 9. The pin 10 then extends under action of spring 8 toward the tapered conical slope 93 of rod 9 disposed between locking group 92 and a stop surface 94 at the end area of rod 9 near the spring 11. The opening of contacts SW4 also opens the time delay circuit including the IC circuit. Thus, the iron of the present invention will not cause fire even if left in a horizontal position because power to the heating coil and control circuit are cut off.

When the operator desires to use the iron again, downward pressure applied to grip 1 causes rod 9 to retract within tube 13 against spring 11 so that locking pin 10 is cammed by the conical slope 93 of the rod 9 and locked in groove 92 to once again lock the rod 9 in retracted position in tube 13. In th meantime, switch contact SW4 has beem moved to the closed position to complete the circuit to the heater and the time delay circuit. By depressing plunger 2 while the operator's hand remains holding the grip 1, contacts SW2 and SW1 in the switch 3 again are respectively opened and closed to complete the circuit to the heating coil 6, so that the iron may be used for ironing while the time delay circuit is inactivated.

Figure 5:
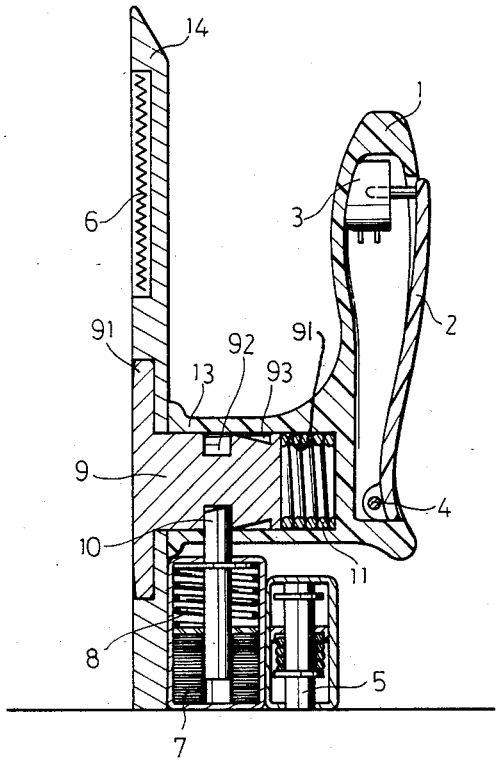
FIG. 5 shows the iron supported and in an upright position.

FIG. 5 shows the iron in upright supported position against the heel of the grip 1. The iron is preheated without using switch 3 by standing the iron on the heel of grip 1 to depress push-button 5 connected to switch contact SW3 and SW5. Contacts SW3 are normally open and contacts SW5 are normally closed when button 5 is extended. In such condition, switch 3 controls the circuits to the heater and the IC time delay circuit. When the iron is supported in an upright position with push-button 5 retracted or depressed, the positions of contacts SW3, SW5 are reversed or depressed, the positions of contacts SW3, SW5 are reversed so that the circuit to heater 6 is closed and the circuit to the time delay circuit is opened.

FIG. 6 shows the electronic control circuit for the present invention. A transformer T has two step-down coils on the secondary side in circuit with a full wave rectifier. The first secondary coil is connected to two diodes D1, D2 from where output of positive rectified voltage will be fed to the positive side of thyrister SCR which is in series with coil S of the solenoid 7 to complete a circuit with the negative side of the supply voltage. The gate of the SCR remains passie with SCR not in conduction and with solenoid 7 consituting part of the circuit loop. The second secondary coil is in series connection with two diodes D3, D4 from where output of positive rectified voltage will be fed to the IC by way of switch contacts SW1, SW5 to form a time delay circuit with resistors R1, R2 and capacitors C3 and C4. Capacitors C1, C2 are provided as filters. The reference symbol "S" in the figure represents the induction coil of the solenoid 7 while switch contact SW2 controls the heating coil 6 and SW1 controls power to the control circuit IC. The switch contacts SW3 are part of the preheating switch 5 for the heating coil and contacts SW5 are contacts in circuit with the IC time delay circuit.

To actuate the solenoid, the SCR must be set to conduction by having an incitation voltage carried in the form of a pulse signal released from the IC circuit and received at the gate thereof. Further reference may be had to FIGS. 3–5, in which it is seen that the control circuit receives power when the iron body is set upright to stand on its rear edge. The push-button switch 5 will be repressed due to the weight of the iron and contact SW3 is closed to bring the heating coil 6 into a heat-up condition. Since contact SW5 is interdependently associated with contact SW3, it is opened when buttom 5 is depressed to cut off the power to the time delay circuit IC. During ironing, the operator's hand must continue holding grip 1 so that the plunger 2 is depressed to actuate switch 3, whereupon the contact SW2 will be closed and the heater energized. The contact SW1 will be open to cut off power to the IC to deactivate same. Contact SW5 is closed (push-button extended) and SW1 is in series with SW5. SW1 remains open while ironing is carried out and control circuit IC remains inactive.

When the ironing operation is stopped or suspended following withdrawal of the operator's hand from the iron grip 1, contact SW2 of switch 3 is opened and contact SW1 is closed to energize the IC circuit. After a predetermined time delay, the IC generates a voltage pulse to the gate of SCR so that SCR is rendered conductive. Solenoid 7 will induce the pin 10 to withdraw from the locking groove 92 upon energization, resulting in uplifting of the iron body 14 by means of the main spring 11. The contact SW4 is opened by movement of pin 10, thereby cutting off the power to the control circuit IC, the heating coil 6 and the coil S of the solenoid 7. Locking pin spring 8 extends pin 10 to engage the tapered slope 93 of rod 9 and the stop surface 94, whereupon the iron body 14 is kicked off the surface of fabric upon which ironing is being carried out.

To resume operation after the iron body 14 has been moved up, iron body 14 is depressed by manipulating grip 1 to cause rod 9 to retract within tube 13 against compression spring 11. The pin 10 will cam along the conical slope 93 to reach groove 92 and once again engage same. In the meantime, the contact SW4 has been closed upon return of pin 10 and contact SW2 is also depressed by the grip plunger 2 to close the circuit to heater 6 and open the circuit including the IC time delay circuit.

The principles, preferred embodiments and modes of operation of the present invention have been described in the foregoing specification. The invention which is intended to be protected herein should not, however, be construed as limited to the particular forms described, as these are to be regarded as illustrative rather than restrictive. Variations and changes may be made by those skilled in the art without departing from the spirit of the invention. Accordingly, the foregoing detailed description should be considered exemplary in nature and not as limiting to the scope and spirits of the invention set forth in the appended claims.

I claim:

1. An electric safety iron comprising:

an iron body and a grip section for the iron;

a main control switch for controlling a heater circuit of the iron, including a normally open switch that is closed by an operator during use of the iron;

a tube interconnecting the grip section with the upper side of the iron body, said tube enclosing a hollow core;

an aperture in the iron body aligned with the hollow core of the tube;

a movable support rod slidably positioned for extension and retraction at least in part within the hollow core of the tube, said rod having a locking surface disposed thereon, the rod extending through the aperture in the iron body and terminating substantially flush with the bottom of the iron body when in its retracted position within the tube and extending beyond the bottom of the body of the iron in its extended position;

spring means normally biasing the rod toward its extended position;

a locking pin associated with the tube and movable between an extended position where it engages the locking surface of the support rod and a retracted position out of engagement with the locking surface of the rod, said rod being locked against extension when said pin engages said locking surface;

electrical control means for controlling movement of the locking pin between said extended and retracted positions, including a time delay circuit for causing retraction of the pin away from the support rod locking surface when the main control switch is left open for a predetermined time period while the iron is supplied with electrical energy; and means for limiting the maximum degree of extension of the rod out of the tube relative to the body of the iron.

2. The safety iron as claimed in claim 1, said rod having an enlarged end area adjacent the bottom of the iron body and said iron body including an enlarged opening adjacent the aperture therein for receiving said enlarged end area.

3. The safety iron as claimed in claim 2, wherein said means for limiting the maximum degree of extension of the rod comprises a stop surface engageable with said locking pin when the rod is at its extended position.

4. The safety iron as claimed in claim 3 including a surface of the rod between said locking surface and said stop that slopes inwardly from a larger to a smaller dimension so that motion of the rod from its extended to its retracted positon cams the locking pin toward a retracte position, and spring means for normally biasing the locking pin toward its extended position.

5. The safety iron as claimed in claim 4, said locking surface comprising an undercut groove in the rod surface.

6. The safety iron as claimed in claim 1, said tube and rod being cylindrical in configuration; said locking surface comprises an annular groove in the surface of the support rod; said locking pin radially extends through the tube wall in its extended position; spring means for normally biasing the locking pin toward its extended position, and said electrical control means being arranged to retract the pin against the bias of said spring means when actuated.

7. The safety iron as claimed in claim 1, said rod having an enlarged end area adjacent the bottom of the iron body and said iron body including an enlarged opening adjacent the aperture therein for receiving said inlarged end area.

8. The safety iron as claimed in claim 1, said locking pin control means comprising a solenoid that retracts the locking pin when energized; spring means for normally biasing the locking pin toward its extended position; an electrical circuit means associated with the locking pin, said electrical circuit means arranged to de-energize said solenoid and to open the heater circuit of the iron when the locking pin is moved toward its retracted position, whereby the locking pin, upon energization of the solenoid, is withdrawn form engagement with the support rod locking surface momentarily and then biased toward the support rod after its initial retraction.

9. The safety iron as claimed in claim 8, including a normally open heater circuit override switch disposed on said iron, said override switch arranged to close an electrical circuit including the heater to energize the heater when the iron is placed in an upright positon, even if the main control switch is open.

10. The safety iron as claimed in claim 9, said grip including a heel portion for engaging a support surface when the iron is in an upright position, said override switch comprising a push-button on said heel portion arranged to be actuated to a closed position when the iron is placed in an upright position and to be actuated to an open position when the iron is not in an upright position.

* * * * *